United States Patent [19]

Borst

[11] Patent Number: 4,739,900

[45] Date of Patent: Apr. 26, 1988

[54] RECLOSABLE DISPENSER PACKAGE

[75] Inventor: Rodney D. Borst, Oregon, Wis.

[73] Assignee: Placon Corporation, Madison, Wis.

[21] Appl. No.: 935,406

[22] Filed: Nov. 26, 1986

[51] Int. Cl.[4] ..... B65D 43/14

[52] U.S. Cl. ..... 220/339; 220/315; 220/257; 220/335; 222/517

[58] Field of Search ..... 220/254, 339, 257, 335, 220/337, 315; 222/153, 517, 556

[56] References Cited

U.S. PATENT DOCUMENTS

| | | | |
|---|---|---|---|
| 3,344,974 | 10/1967 | Bostrom | 220/257 |
| 3,904,074 | 9/1975 | Hoffman et al. | 220/339 |
| 4,095,712 | 6/1978 | Perrela | 220/254 |
| 4,144,985 | 3/1979 | Kinslow | 220/254 |
| 4,361,250 | 11/1982 | Foster | 220/266 |
| 4,428,497 | 1/1984 | Julius et al. | 220/339 |
| 4,487,328 | 12/1984 | Wilcox et al. | 220/254 |
| 4,494,679 | 1/1985 | Cleevely | 222/151 |

*Primary Examiner*—Stephen Marcus
*Assistant Examiner*—Nova Stucker
*Attorney, Agent, or Firm*—Isaksen, Lathrop, Esch, Hart & Clark

[57] ABSTRACT

A reclosable dispenser package of thin flexible thermoformed plastic material and method of manufacture is disclosed, the package including a base with peripheral edges and a cover thermoformed from a sheet of plastic which includes a cover wall with a dispensing opening therein defined by an inner margin, peripheral edges which are joined to the peripheral edges of the base so that the cover is closed upon and substantially covers the base, and a tubular lid integrally hinged to the cover at a hinge line forming a portion of the inner margin. The tubular lid includes an upper lid wall, a lower wall, and a forward surface. The cover wall further includes an arresting platform on which the tubular lid rests when in its closed position. The tubular lid pivots around the hinge line to open and close the dispensing opening.

37 Claims, 3 Drawing Sheets

RECLOSABLE DISPENSER PACKAGE

BACKGROUND OF THE INVENTION

1. Field of the Invention

This invention pertains generally to the field of packaging and containers, and particularly to plastic containers having a cover thermoformed from a sheet of plastic, the cover having an integral lid which is intended to be repeatedly closed and reopened.

2. Description of the Prior Art

Several different products are currently packaged in reclosable dispenser packages which have covers with integral lids which close onto a portion of the remainder of the cover. One type of dispenser package includes a cover having an opening therein and an integral lid which closes onto the opening and a portion of the cover which surrounds the opening. The portion of the cover which surrounds the opening forms an arresting platform upon which the lid rests when closed over the opening. This type of thermoplastic container, however, generally has a cover which is either originally formed from two separate sheets of plastic, one to form the lid and the other to form the remainder of the cover, which are later joined together, or are formed from some process which does not involve the thermoforming of sheets of plastic at all.

Other types of packages have container bodies which are closed with a cover which is divided into two portions, a stationary portion and a movable door portion which forms the lid. In this type of packaging system, the movable door portion or lid closes onto the container base itself and not onto any portion of the remaining cover. When the lid is open, this type of cover is secured to the container base only by the stationary portion of the cover. The lid or movable door portion, often which is a large portion of the cover, is released from the base when opened. As a result, the cover may not be held onto the base very securely when open. Additionally, often this type of container is not made by the thermoforming of plastic sheets.

The thermoforming of thin sheets of plastic material to form packages is a simple and inexpensive process for manufacturing packaging containers. While such a process might be used to thermoform a cover with integral lid which closes over an opening within the cover and a portion of the cover surrounding the opening, prior to the present invention the process would involve using two separate sheets of plastic to form the cover and integral lid which are subsequently joined together. Consequently, there is a need for a cover which is thermoformed from a single sheet of thin plastic material, which cover has a lid that can close onto an opening within the cover in such a fashion that when closed the lid also rests on a portion of the remaining cover which surrounds the opening. Since the remaining portion of the cover entirely surrounds the lid, the cover may be permanently secured to the base of the container wherever the cover and base meet.

SUMMARY OF THE INVENTION

A reclosable dispenser package of thin thermoformed plastic material in accordance with the present invention has a cover which is formed from a single sheet of plastic, the cover including a cover wall with a dispensing opening therein, peripheral edges which can be joined to the peripheral edges of the base so that the cover is closed upon and substantially covers the base, and a tubular lid which is integrally hinged to the cover wall at a hinge line. The tubular lid includes an upper lid wall, a lower lid wall, and a forward surface. The tubular lid is movable to open and close the dispensing opening in such a manner that when the tubular lid is closed, it rests upon a portion of the cover wall which is called an arresting platform. The reclosable dispenser package generally has a cover which has some means for releasably locking the lid into a closed position over the dispensing opening.

The present invention is particularly unique over the related art in that the cover with its lid is thermoformed from a single sheet of plastic material, yet the lid is a tubular lid having two walls. When the tubular lid is in a closed position overlying the dispensing opening, the lid rests upon an arresting platform which is also a portion of the cover. Additionally, though formed from a single sheet of thermoplastic material, the cover has a means for releasably locking the lid into a closed position so that it closes the dispensing opening and overlies the arresting platform.

The manufacture of reclosable dispenser packages according to the present invention requires a special method of production. A substantially rectangular plastic sheet of material is first heated to a temperature at which the plastic sheet is formable and then is placed over a mold. The heated plastic sheet is then drawn into the mold from one side so that the plastic sheet is formed into a cover which has a cover wall, peripheral edges, and a tubular lid joined to and projecting outwardly from the cover wall. The sheet is drawn down into a long narrow dip to form the tubular lid, the dip descending from that flatter portion of the mold which forms the top portion of the cover wall. As formed, the tubular lid includes an upper lid wall, a lower lid wall, and a forward surface, both walls of the lid projecting outwardly from the cover wall so that at least one of the lid walls intersects the cover wall at approximately a perpendicular angle. The cover then is allowed to cool and is removed from the mold so that the dispensing opening may be cut into the cover wall. The dispensing opening is defined by an inner margin within the cover wall, a portion of the inner margin being formed by a hinge line between a lid wall and cover wall so that the tubular lid may open and close over the dispensing opening by pivoting about the hinge line.

Since the tubular lid is formed from an outwardly extending, hollow portion of the cover and the dispensing opening is cut after the forming of the cover, the tubular lid may be formed and the dispensing opening cut in such a fashion that the tubular lid may pivot to close the dispensing opening and when closed also rest on a portion of the cover called the arresting platform. Additionally, the tubular lid may be formed so that it has two lid walls instead of just a single wall. Since the tubular lid closes onto a portion of the cover wall, the cover wall may be formed so that a portion of it will overlie a portion of the tubular lid when the tubular lid is in a closed position, thereby releasably locking the tubular lid in a closed position.

Other objects, features, and advantages of the invention will be apparent from the following detailed description taken in conjunction with the accompanying drawings showing a preferred embodiment of the invention.

DESCRIPTION OF THE PREFERRED EMBODIMENT

Figure 1:
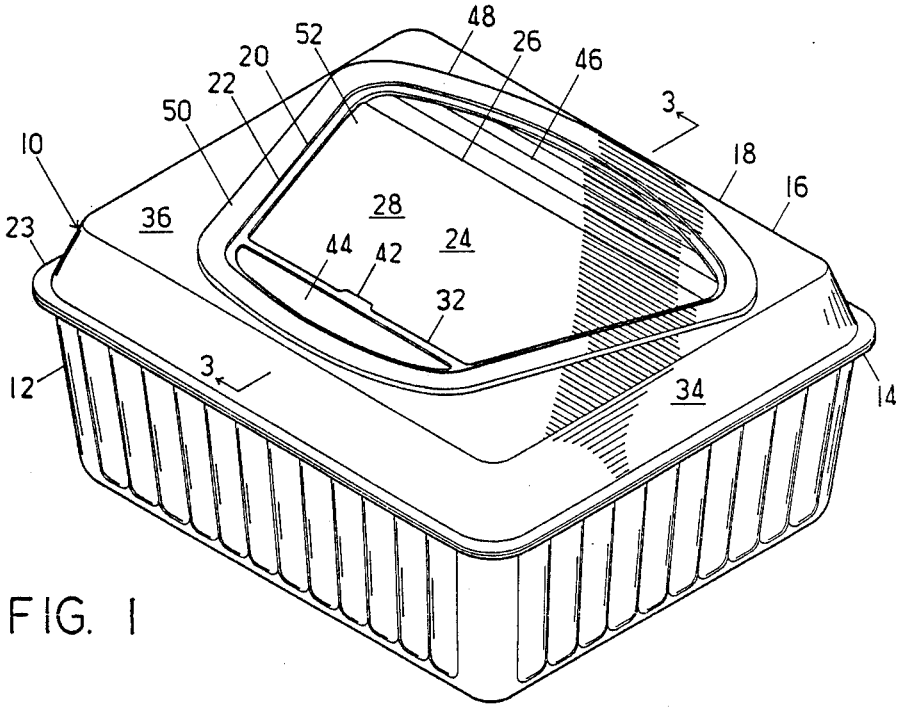
FIG. 1 is a perspective view of a reclosable dispenser package according to the present invention, with the tubular lid in a closed position.
Figure 2:
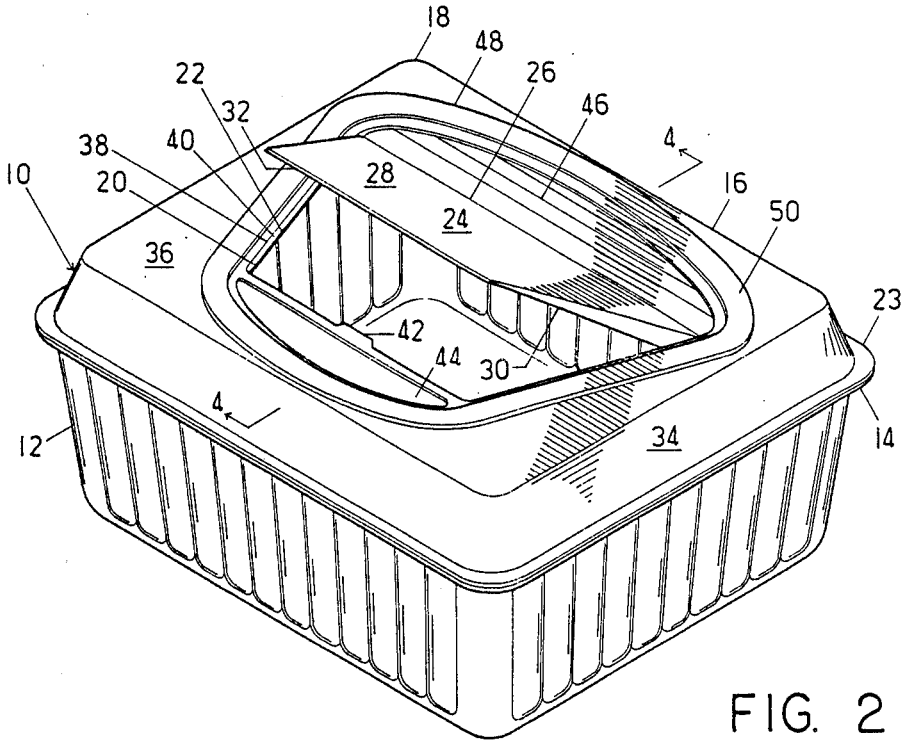
FIG. 2 is a perspective view of a reclosable dispenser package according to the present invention, with the tubular lid in an open position.

Referring more particularly to the drawings, wherein like numbers refer to like parts, FIGS. 1 and 2 show a reclosable dispenser package 10 of thin flexible thermoformed plastic material with a base 12 having peripheral edges 14, and a cover 16 which includes a cover wall 18 with a dispensing opening 20 therein defined by an inner margin 22.

Figure 3:
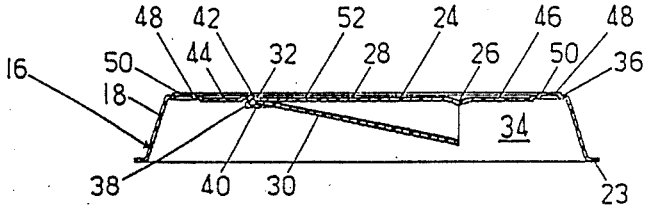
FIG. 3 is a cross-section view of the cover only taken along section line 3—3 of FIG. 1.
Figure 4:
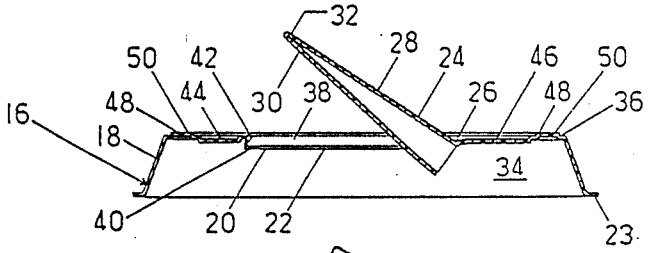
FIG. 4 is a cross-section view of the cover only taken along section line 4—4 of FIG. 2.

The cover 16 further has peripheral edges 23 and a tubular lid 24 which is integrally hinged to the cover wall 18 at a hinge line 26. The cover wall 18 is that portion of the cover 16 which does not include the tubular lid 24. The hinge line 26 forms a portion of the inner margin 22 which defines the dispensing opening 20. The tubular lid 24 includes an upper lid wall 28, a lower lid wall 30, and a forward surface 32 as shown in FIGS. 3 and 4. Although the reclosable dispenser package shown in FIGS. 1 and 2 has a generally rectangular base 12 and cover 16, the base 12 and cover 16 may have any desired shape, for example, round, oblong, rectangular or polygonal, etc. The reclosable dispenser package 10 cover wall 18 includes sides 34 which extend downwardly from and are integrally connected to a top portion 36 of the cover wall 18. The cover wall 18 of the cover 16, however, may also be substantially flat, without any sides 34.

The cover wall 18 further includes a descending portion 38 which descends from the top portion 36 of the cover wall 18 to join to an arresting platform 40 which the tubular lid closes onto and overlies when in a closed position. The cover wall 18 has, a lug 42 which overlies a portion of the arresting platform 40 such that when the tubular lid 24 is in a closed position, a portion of the lower lid wall 30 overlies the arresting platform 40 and the lug 42 overlies a portion of the tubular lid 24, releasably holding the tubular lid 24 in a closed position over the dispensing opening 20 and arresting platform 40. When pressed, a pressure portion 44 of the cover wall 18 which is adjacent the lug 42 causes the lug 42 to move away from its position overlying the upper lid wall 28, thereby releasing the tubular lid 24 so that it can be moved into an open position. The tubular lid 24 preferably is biased toward its open position so that when the pressure portion 44 is pressed, the tubular lid 24 automatically snaps open to at least a partially open position. The preferred cover wall 18 includes a shoulder portion 46 which is adjacent the hinge line 26. An annular ridge 48 surrounds the pressure portion 44, the dispensing opening 20, arresting platform 40, and shoulder portion 46, thereby strengthening the cover wall 18 and providing an elevated surface 50 on which a removable moisture impermeable sheet (not shown) may be applied to seal the package before it is sold. When the tubular lid 24 is in its closed position, the lid 24 and top portion 36 of the cover wall 18 together present a substantially flat surface 52 over which the removable moisture impermeable sheet may be applied. The cover 16 of the preferred reclosable dispenser package 10 is formed from a sheet of plastic material, examples of which are polystyrene, acrylic polymer, polyvinylchloride, acrylonitrile butyl styrene (ABS), or polyester. The cover 16 is joined by its peripheral edges 23 to the peripheral edges 14 of the base 12 and the two sets of edges are hermetically sealed together, as by radio frequency heating.

Figure 5:
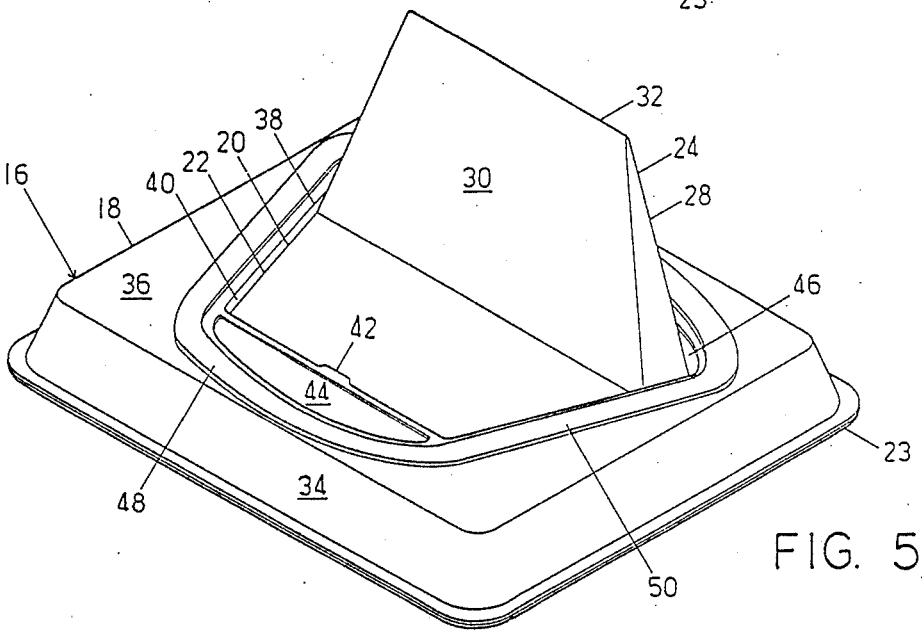
FIG. 5 is a perspective view of a reclosable dispenser package cover after it has been molded, but before the dispensing opening has been cut therein.
Figure 6:
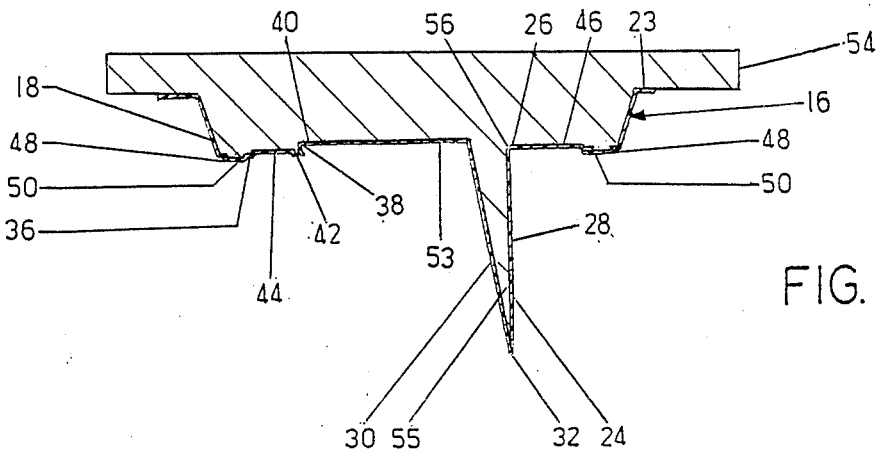
FIG. 6 is a cross-section view of a reclosable dispenser package cover while it is still on its mold.

Referring to FIG. 5, the preferred reclosable tubular lid 24 extends outwardly from the top portion 26 of the cover wall 18 after it has been molded, and before any dispensing opening 20 has been cut into the cover wall 18. The cover 16 is manufactured using thermoforming technology by taking a substantially rectangular plastic sheet 53, heating that sheet to a temperature so that it is formable, and then placing the heated plastic sheet over a mold 54. The heated plastic sheet 53 is then drawn onto the mold from one side of the plastic sheet 53 so that the plastic sheet is formed into a cover 16 as shown in FIG. 6. The cover 16 has a cover wall 18, peripheral edges 23, and a tubular lid 24 which projects outwardly from the mold 54 from the cover wall 18. To form the tubular lid 24, the mold 54 must have a long, narrow projection 55 over which the plastic sheet 53 is drawn. The tubular lid 24 which extends outwardly from the mold 54 includes the lower lid wall 30, upper lid wall 28, and forward surface 32. One of the lid walls 28 or 30 joins the cover wall 18 at approximately a perpendicular angle (e.g., at the joint 56 between the wall 28 and the cover wall as shown in FIG. 6) such that the intersection of the lid wall and cover wall can form the incipient hinge line 26. The cover 16 is allowed to cool and is removed from the mold 54. The dispensing opening 20 is then cut into the cover wall 18 so that a portion of the inner margin 22 which defines the dispensing opening 20 is formed by the hinge line 26. When the cutting is completed the tubular lid 24 should pivot about the hinge line 26 to open and close over the dispensing opening 20. Additionally, the dispensing opening 20 should be cut so that a portion of the cover wall 18 remains to form the arresting platform 40 on which the tubular lid 24 rests when closed.

Figure 7:
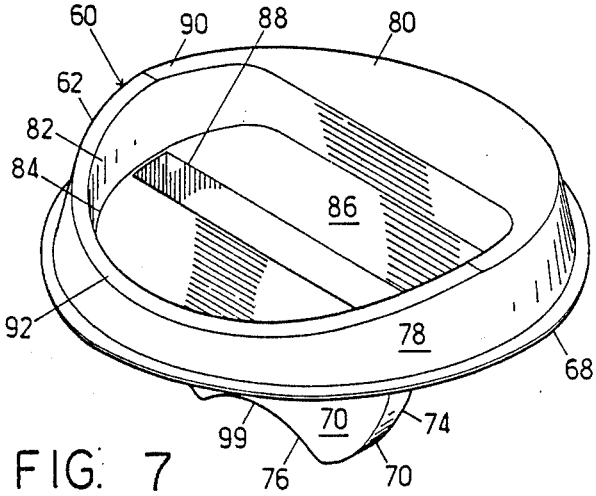
FIG. 7 is a perspective view of an alternate reclosable dispenser package cover before the dispensing opening has been cut therein.
Figure 8:
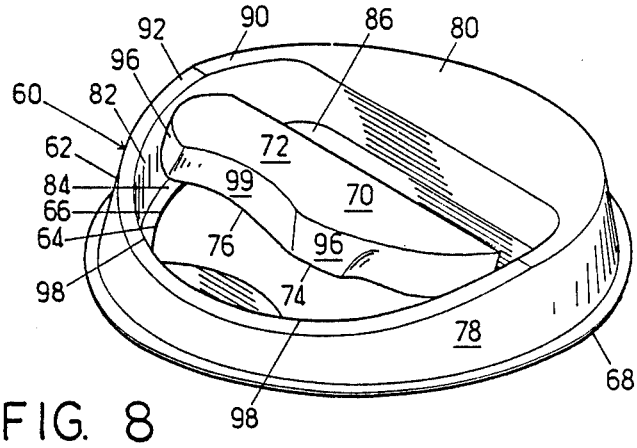
FIG. 8 is a perspective view of the alternate reclosable dispenser package cover with the tubular lid in an open position.
Figure 9:
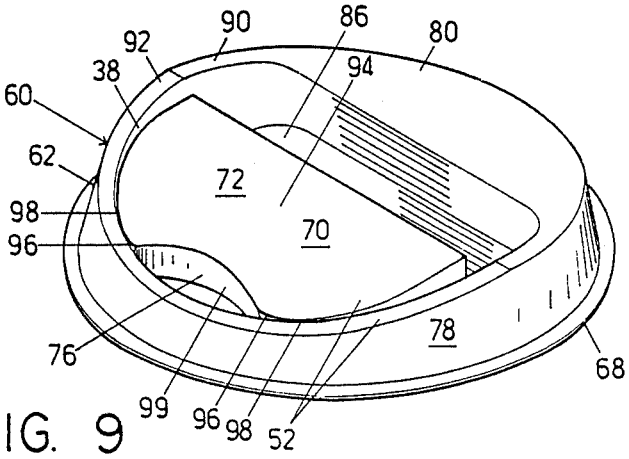
FIG. 9 is a perspective view of the alternate reclosable dispenser package cover with the tubular lid in a closed position.

An alternative reclosable dispenser package 10 cover 16 is shown in FIGS. 7, 8 and 9. Somewhat similar to the preferred reclosable dispenser package 10 cover 16, the alternate cover 60 has a cover wall 62 with a dispensing opening 64 defined by an inner margin 66, and also has peripheral edges 68 which may be joined to a base (not shown) at its peripheral edges (not shown). The alternate cover 60 also has a tubular lid 70 which includes an upper lid wall 72, a lower lid wall 74, and a forward surface 76. Sides 78 may extend downwardly from and be integrally connected to a top portion 80 of the cover wall 62. The tubular lid 70 is tapered so that the upper lid wall 72 and lower lid wall 74 form about a nine degree angle to each other. The cover wall 62 includes a descending portion 82 which descends from a top portion 80 of the cover wall 62 down to an arresting platform 84 upon which the tubular lid 70 closes onto and overlies when in a closed position. The cover wall 62 also has a shoulder portion 86 which lies adjacent to the hinge line 88 and an annular ridge 90 which surrounds the dispensing opening 64, arresting platform 84, and the shoulder portion 86, thereby strengthening the cover wall 62 and providing an elevated surface 92 on which a removable moisture impermeable sheet (not shown) may be applied to seal the reclosable dispenser package. The top portion 80 of the cover wall 62 and the tubular lid 70 when closed together form a substantially flat surface 94 over which a removable moisture impermeable sheet may be applied. In the alternate reclosable dispenser cover 60, the descending portion 82 and arresting platform 84 abut and releasably mate with the forward surface 76 and a portion of the lower lid wall 74 of the tubular lid 70 which overlies the arresting platform 84 when the tubular lid 70 is in a closed position. The descending portion 82 has two locking portions 98 and the tubular lid 70 includes two protruding portions 96 which mate with the locking portions 98 when the tubular lid 70 is in its closed position so that the locking portions 98 overlie the protruding portions 96, thereby releasably holding the tubular lid 70 in a closed position over the dispensing opening 64 and arresting platform 84.

Additionally, the alternate cover 60 tubular lid 70 is biased toward its closed position. A notch 99 is shaped into the forward surface 76 of the tubular lid 70 so that a user can open the tubular lid 70 by placing a finger (not shown) in the notch 99 and pulling the lid 70 open.

The alternate reclosable dispenser package cover 60 is manufactured by much the same method as the preferred cover 16 except that the alternate tubular lid 70 is formed to extend from the cover wall 62 in an opposite direction than the direction in which the tubular lid 24 extends in the preferred cover 16 shown in FIG. 5. As shown in FIG. 7, when the alternate cover 60 is taken out of the mold, the tubular lid 70 extends downwardly from the cover wall 62 rather than upwardly. The dispensing opening 64 is cut so that a portion of the inner margin 66 defining the dispensing opening 64 is formed by the hinge line 88, and so that a portion of the cover wall 62 remains as an arresting platform 84. Since the tubular lid 70 in its molded position underlies the cover 60, the tubular lid 70 must be pulled upwardly through the dispensing opening 64 so that it overlies the dispensing opening 64 as shown in FIG. 8. As a result of the tubular lid 70 being molded in a downward position, the tubular lid 70 is biased toward its closed position which is shown in FIG. 9.

Although the tubular lid 24 or 70 may be formed as shown in the preferred embodiment in FIG. 2 or the alternate embodiment as shown in FIG. 8, other shapes may also be utilized. Although the invention may be manufactured with a variety of materials commonly utilized form such packages, it is particularly adapted to packages made of plastics which can be thermoformed from a one-piece sheet of plastic stock material. Suitable initial plastic stocks include high impact polystyrene, polyester, polyvinylchloride, acrylonitrile butyl styrene (ABS) and acrylic copolymers. The typical sheet thicknesses for such plastic packages may be utilized in accord with the invention, for example, in the 20 to 50 thousandths of an inch range.

The reclosable dispenser package is particularly suited to be used with products which must be sealed such as paper tissues containing a liquid agent. Before sale the lid may be sealed using a removable moisture impermeable sheet which is applied to the elevated surface 50 on the annular ridge 48. The moisture impermeable sheet may be removed by the user so that the tubular lid 24 may then be opened by the user. The peripheral edges 23 of the cover 16 should be joined to the peripheral edges 14 of the base 12 by a high integrity sealing technique, such as radio frequency heating, so that they are hermetically sealed together.

The cover 16 and base 12 of the reclosable dispenser package may be manufactured in a kit form, whereby the base 12 and the cover 16 each further include a flange (not shown). The cover flange and base flange should be shaped so as to mate when placed together so that the cover and base seat together with the peripheral edge 23 of the cover 16 closing upon the peripheral edge 14 of the base 12.

It is understood that the invention is not confined to the particular construction and arrangements herein illustrated and described, but embraces such modified forms thereof as come within the scope of the following claims.

What is claimed is:

1. a unitary cover of thin flexible thermoformed plastic material for a reclosable dispenser package having a base and cover, comprising:

(a) a cover wall with a dispensing opening therein defined by an inner margin, the cover wall having peripheral edges;

(b) a tubular lid hinged to the cover wall at a hinge line formed as a continuation of the material forming the inner margin and the tubular lid, the tubular lid including an upper lid wall, a lower lid wall and a forward surface, the tubular lid being movable to open and close the dispensing opening.

2. The cover specified in claim 1 wherein the cover wall further includes sides extending downwardly from a top portion of the cover wall, the top portion and sides being integrally connected together.

3. The cover specified in claim 1 wherein the cover wall includes an annular ridge surrounding at least the dispensing opening, strengthening the cover wall and providing an elevated surface on which a removable moisture impermeable sheet may be applied.

4. The cover specified in claim 1 wherein the cover wall further includes a descending portion which abuts and releasably mates with the forward surface of the tubular lid when the tubular lid is in a closed position.

5. The cover specified in claim 1 wherein the cover wall in conjunction with the tubular lid in a closed position form a substantially flat surface over which a removable moisture impermeable sheet may be applied.

6. The cover specified in claim 1 wherein the cover is integrally formed of a plastic material selected from the group consisting of polystyrene, acrylic polymer, polyvinylchloride, ABS, and polyester.

7. The cover specified in claim 1 further including a flange which extends outwardly from the peripheral edges of the cover wall, the flange having a bottom surface which is adapted to mate with a top surface of a flange on the base so that the cover and base seat together so that the peripheral edge of the cover is closed upon a peripheral edge of the base.

8. The cover specified in claim 7 wherein the cover peripheral edges may be joined to the peripheral edges of a base and sealed hermetically by radiofrequency heating, whereby the flanges of the base and cover may be cut off.

9. The cover specified in claim 1 wherein the cover wall further includes an arresting platform upon which the tubular lid closes onto and overlies when closed.

10. The cover specified in claim 9 wherein the cover wall includes an annular ridge surrounding at least the dispensing opening and arresting platform, strengthening the cover wall and providing an elevated surface on which a removable moisture impermeable sheet may be applied.

11. The cover specified in claim 9 wherein the cover wall further includes a descending portion which descends to join the arresting platform, the descending portion and arresting platform abutting and releasably mating with the forward surface and a portion of the lower lid wall which overlies the arresting platform when the tubular lid is in a closed position.

12. The cover specified in claim 11 wherein the descending portion of the cover wall includes at least one locking portion and the tubular lid further includes at least one protruding portion which mates with the locking portion when the tubular lid is in a closed position so that the locking portion overlies the protruding portion releasably holding the tubular lid in a closed position over the dispensing opening.

13. A reclosable dispenser package comprising:

(a) a base having peripheral edges;

(b) a unitary cover of thin flexible thermoformed material, the cover including (i) a cover wall with a dispensing opening therein defined by an inner margin, (ii) peripheral edges which are joined to the peripheral edges of the base so that the cover is closed upon and substantially covers the base, and (iii) a tubular lid hinged to the cover wall at a hinge line formed as a continuation of the material forming the inner margin and the tubular lid, the tubular lid including an upper lid wall, a lower lid wall, and a forward surface, the tubular lid being movable to open and close the dispensing opening.

14. The reclosable dispenser package specified in claim 13 wherein the cover wall further includes sides extending downwardly from a top portion of the cover wall, the top portion and sides being integrally connected together.

15. The reclosable dispenser package specified in claim 13 wherein the cover wall includes an annular ridge surrounding at least the dispensing opening, strengthening the cover wall and providing an elevated surface on which a removable moisture impermeable sheet may be applied.

16. The reclosable dispenser package specified in claim 13 wherein the cover wall further includes a descending portion which abuts and releasably mates with the forward surface of the tubular lid when the tubular lid is in a closed position.

17. The reclosable dispenser package specified in claim 13 wherein the cover wall top portion in conjunction with the tubular lid in a closed position form a substantially flat surface over which a removable moisture impermeable sheet may be applied.

18. The reclosable dispenser package specified in claim 13 wherein the cover peripheral edges are joined to the peripheral edges of the base and hermetically sealed by radiofrequency heating.

19. The reclosable dispenser package specified in claim 13 wherein the cover is integrally formed of a plastic material selected from the group consisting of polystyrene, acrylic polymer, polyvinylchloride, ABS, and polyester.

20. The reclosable dispenser package specified in claim 13 wherein the cover wall further includes an arresting platform upon which the tubular lid closes onto and overlies when closed.

21. The reclosable dispenser package specified in claim 20 wherein the cover wall includes an annular ridge surrounding at least the dispensing opening and arresting platform, strengthening the cover wall and providing an elevated surface on which a removable moisture impermeable sheet may be applied.

22. The reclosable dispenser package specified in claim 20 wherein the cover wall further includes a descending portion which descends to join the arresting platform, the descending portion and arresting platform abutting and releasably mating with the forward surface and a portion of the lower lid wall which overlies the arresting platform when the tubular lid is in a closed position.

23. The reclosable dispenser package specified in claim 20 wherein the descending portion of the cover wall includes at least one locking portion and the tubular lid further includes at least one protruding portion which mates with the locking portion when the tubular lid is in a closed position so that the locking portion overlies the protruding portion releasably holding the tubular lid in a closed position over the dispensing opening.

24. A cover for a reclosable dispenser package having a base and cover, comprising:

(a) a cover wall with a dispensing opening therein defined by an inner margin, the cover wall having peripheral edges;

(b) a tubular lid integrally hinged to the cover wall at a hinge line forming a portion of the inner margin, the tubular lid including an upper lid wall, a lower lid wall and a forward surface, the tubular lid being movable to open and close the dispensing opening, and wherein the entire cover is thermoformed from a sheet of plastic;

wherein the hinge line between the tubular lid and cover wall is formed by an intersection of a lid wall and the cover wall at a substantially perpendicular angle when molded and before the tubular lid has been moved from that perpendicular angle with the cover wall.

25. A cover for a reclosable dispenser package having a base and cover, comprising:

(a) a cover wall with a dispensing opening therein defined by an inner margin, the cover wall having peripheral edges;

(b) a tubular lid integrally hinged to the cover wall at a hinge line forming a portion of the inner margin, the tubular lid including an upper lid wall, a lower lid wall and a forward surface, the tubular lid being movable to open and close the dispensing opening, and wherein the entire cover is thermoformed from a sheet of plastic;

wherein the tubular lid is tapered so that the upper lid wall and lower lid are at their closest to each other and are joined at the forward surface of the tubular lid.

26. A cover for a reclosable dispenser package having a base and cover, comprising:

(a) a cover wall with a dispensing opening therein defined by an inner margin, the cover wall having peripheral edges;

(b) a tubular lid integrally hinged to the cover wall at a hinge line forming a portion of the inner margin, the tubular lid including an upper lid wall, a lower lid wall and a forward surface, the tubular lid being movable to open and close the dispensing opening, and wherein the entire cover is thermoformed from a sheet of plastic;

wherein the cover wall further includes an arresting platform upon which the tubular lid closes and overlies when closed;

wherein the cover wall further includes a descending portion which descends to join the arresting platform, the descending portion and arresting platform abutting and releasably mating with the forward surface and a portion of the lower lid wall which overlies the arresting platform when the tubular lid is in a closed position;

wherein the descending portion of the cover wall includes at least one locking portion and the tubular lid further includes at least one protruding portion which mates with the locking portion when the tubular lid is in a closed position so that the locking position overlies the protruding portion releasably holding the tubular lid in a closed position over the dispensing opening; and wherein the tubular lid is biased toward the closed position and a notch is shaped in the forward surface of the tubular lid so that a user may open the lid by placing a finger in the notch and pulling the lid open.

27. A cover for a reclosable dispenser package having a base and cover, comprising:

(a) a cover wall with a dispensing opening therein defined by an inner margin, the cover wall having peripheral edges;

(b) a tubular lid integrally hinged to the cover wall at a hinge line forming a portion of the inner margin, the tubular lid including an upper lid wall, a lower lid wall and a forward surface, the tubular lid being movable to open and close the dispensing opening, and wherein the entire cover is thermoformed from a sheet of plastic;

wherein the cover wall further includes an arresting platform upon which the tubular lid closes onto and overlies when closed; and wherein the cover wall further includes a lug which overlies a portion of the arresting platform such that when the tubular lid is in a closed position, a portion of the lower lid wall overlies the arresting platform and the lug overlies a portion of the tubular lid, releasably holding the tubular lid in a closed position over the dispensing opening.

28. The cover specified in claim 27, wherein the cover wall further includes a pressure portion adjacent the lug which when pressed causes the lug to move away from a position overlying the upper lid wall of the tubular lid so that the lug passes downwardly across the forward surface of the tubular lid releasing the tublar lid so it may be moved to an open position.

29. The cover specified in claim 28 wherein the tubular lid is biased toward the open position so that when the pressure portion of the wall is pressed, the tubular lid automatically snaps open to at least a partially open position.

30. The cover specified in claim 28 wherein the cover wall further includes a shoulder portion adjacent the hinge line forming a portion of the inner margin, and an annular ridge surrounding the pressure portion, dispensing opening, and shoulder portion, strengthening the cover wall and providing an elevated surface on which a removable moisture impermeable sheet may be applied.

31. A reclosable dispenser package of thin flexible thermoformed plastic material, comprising:

(a) a base having periperhal edges;

(b) a cover thermoformed from a sheet of plastic, the cover including (i) a cover wall a dispensing opening therein defined by an inner margin, (ii) peripheral edges which are joined to the peripheral edges of the base so that the cover is closed upon and substantially covers the base, and (iii) a tubular lid integrally hinged to the cover wall at a hinge line forming a portion of the inner margin, the tubular lid including an upper lid wall, a lower lid wall, and a forward surface, the tubular lid being movable to open and close the dispensing opening;

wherein the hinge line between the tubular lid and wall is formed by an intersection of a lid wall and the cover wall at a substantially perpendicular angle when molded and before the tubular lid has been moved from that perpendicular angle with the cover wall.

32. A reclosable dispenser package of thin flexible thermoformed plastic material, comprising:

(a) a base having peripheral edges;

(b) a cover thermoformed from a sheet of plastic, the cover including (i) a cover wall with a dispensing opening therein defined by an inner margin, (ii) peripheral edges which are joined to the peripheral edges of the base so that the cover is closed upon and substantially covers the base, and (iii) a tubular lid integrally hinged to the cover wall at a hinge line forming a portion of the inner margin, the tubular lid including an upper lid wall, a lower lid wall, and a forward surface, the tubular lid being movable to open and close the dispensing opening;

wherein the tubular lid is tapered so that the upper lid wall and lower lid wall are at their closest to each other and joined at the forward surface of the tubular lid.

33. A reclosable dispener package of thin flexible thermoformed plastic material, comprising:

(a) a base having peripheral edges;

(b) a cover thermoformed from a sheet of plastic, the cover including (i) a cover wall with a dispensing opening therein defined by an inner margin, (ii) peripheral edges which are joined to the peripheral edges of the base so that the cover is closed upon and substantially covers the base, and (iii) a tubular lid integrally hinged to the cover wall at a hinge line forming a portion of the inner margin, the tubular lid including an upper lid wall, a lower lid wall, and a forward surface, the tubular lid being movable to open and close the dispensing opening;

wherein the cover wall further includes an arresting platform upon which the tubular lid closes and overlies when closed; and wherein the tubular lid is biased toward the closed position and a notch is shaped in the forward surface of the tubular lid so that a user may open the lid by placing a finger in the notch and pulling the lid open.

34. A reclosable dispenser package of thin flexible thermoformed palstic material, comprising:

(a) a base having peripheral edges;

(b) a cover thermoformed from a sheet of plastic, the cover including (i) a cover wall with a dispensing opening therein defined by an inner margin, (ii) peripheral edges which are joined to the peripheral edges of the base so that the cover is closed upon and substantially covers the base, and (iii) a tubular lid integrally hinged to the cover wall at a hinge line forming a portion of the inner margin, the tubular lid including an upper lid wall, a lower lid wall, and a forward surface, the tubular lid being movable to open and close the dispensing opening;

wherein the cover wall further includes an arresting platform upon which the tubular lid closes and over lies when closed; and wherein the cover wall further includes a lug which overlies a portion of the arresting platform such that when the tubular lid is in a closed position, a portion of the lower lid wall overlies the arresting platform and the lug overlies a portion of the tubular lid, releasably holding the tubular lid in a closed position over the dispensing opening.

35. The reclosable dispenser package specified in claim 34, wherein the cover wall further includes a pressure portion adjacent the lug which when pressed causes the lug to move away from a position overlying the upper lid wall of the tubular lid so that the lug passes downwardly across the forward surface of the tubular lid releasing the tubular lid to be moved to an open position.

36. The reclosable dispenser package specified in claim 35, wherein the tubular lid is biased toward the open position so that when the pressure portion of the cover wall is pressed, the tubular lid automatically snaps open to at least a partially open position.

37. The reclosable dispenser package specified in claim 35, wherein the cover wall further includes a shoulder portion adjacent the hinge line forming a portion of the inner margin, and an annular ridge surrounding the pressure portion, dispensing opening, arresting platform and shoulder portion, strengthening the cover wall and providing an elevated surface on whwich a removable moisture impermeable sheet may be applied.

* * * * *